US008421705B2

(12) United States Patent
Chen

(10) Patent No.: US 8,421,705 B2
(45) Date of Patent: Apr. 16, 2013

(54) ANTENNA STRUCTURE

(75) Inventor: Shuen-Sheng Chen, Taipei Hsien (TW)

(73) Assignee: Wistron NeWeb Corporation, Hsi-Chih, Taipei Hsien (TW)

( * ) Notice: Subject to any disclaimer, the term of this patent is extended or adjusted under 35 U.S.C. 154(b) by 350 days.

(21) Appl. No.: 12/767,805

(22) Filed: Apr. 27, 2010

(65) Prior Publication Data

US 2011/0234470 A1 Sep. 29, 2011

(30) Foreign Application Priority Data

Mar. 26, 2010 (TW) ..... 99109089 A

(51) Int. Cl.
*H01Q 1/36* (2006.01)

(52) U.S. Cl.
USPC ..... 343/895; 343/700 MS; 343/846

(58) Field of Classification Search ..... 343/895, 343/700 MS, 846
See application file for complete search history.

(56) References Cited

U.S. PATENT DOCUMENTS

2003/0156065 A1* 8/2003 Jo et al. ..... 343/700 MS
2006/0152411 A1* 7/2006 Iguchi et al. ..... 343/700 MS
2008/0316108 A1* 12/2008 Chen et al. ..... 343/700 MS
2009/0009401 A1* 1/2009 Suzuki et al. ..... 343/700 MS
2009/0179800 A1* 7/2009 Chiu ..... 343/700 MS

* cited by examiner

*Primary Examiner* — Douglas W Owens
*Assistant Examiner* — Collin Dawkins
(74) *Attorney, Agent, or Firm* — Winston Hsu; Scott Margo

(57) ABSTRACT

An antenna structure includes a positive feeding point, a negative feeding point, a radiation element, and a grounding element. The radiation element includes a first radiator and a second radiator. The first radiator has a first end coupled to the positive feeding point, and has a plurality of first side edges. The second radiator has a first end coupled to the negative feeding point, and has a plurality of second side edges. Herein the second radiator at least partially surrounds the first radiator, such that there are a plurality of predetermined gaps existed in between the plurality of first side edges of the first radiator and the plurality of second side edges of the second radiator to form coupling effects. The grounding element is coupled to the second radiator.

17 Claims, 18 Drawing Sheets

ANTENNA STRUCTURE

BACKGROUND OF THE INVENTION

1. Field of the Invention

The present invention relates to an antenna structure, and more particularly, to an antenna structure for surrounding a first radiator with a second radiator, such that there are a plurality of predetermined gaps existed in between first side edges of the first radiator and second side edges of the second radiator to form coupling effects.

2. Description of the Prior Art

As wireless telecommunication develops with the trend of micro-sized mobile communication products, the location and the space arranged for antennas are limited. Therefore, some built-in micro antennas have been developed. Currently, micro antennas such as chip antennas, planar antennas etc are commonly used. All these antennas have the feature of small volume. The planar antenna has the advantages of small size, light weight, ease of manufacturing, low cost, high reliability, and can also be attached to the surface of any object. Therefore, micro-strip antennas and printed antennas are widely used in wireless communication systems.

Hence, how to improve antenna efficiency, adjust impedance matching, improve radiation patterns, and increase bandwidths of the antennas have become important topics in this field.

SUMMARY OF THE INVENTION

It is one of the objectives of the present invention to provide an antenna structure to solve the abovementioned problems.

According to an embodiment of the present invention, an antenna structure is provided. The antenna structure includes a positive feeding point, a negative feeding point, a radiation element, and a grounding element. The radiation element includes a first radiator and a second radiator. The first radiator has a first end coupled to the positive feeding point, and has a plurality of first side edges. The second radiator has a first end coupled to the negative feeding point, and has a plurality of second side edges. Herein the second radiator at least partially surrounds the first radiator, such that there are a plurality of predetermined gaps existed in between the plurality of first side edges of the first radiator and the plurality of second side edges of the second radiator to form coupling effects. The grounding element is coupled to the second radiator.

These and other objectives of the present invention will no doubt become obvious to those of ordinary skill in the art after reading the following detailed description of the preferred embodiment that is illustrated in the various figures and drawings.

DETAILED DESCRIPTION

Please note that, in order to facilitate the description, the same or similar components are labeled with the same or similar symbols in the follow-up embodiments, and additional description is omitted here for brevity. The present invention is focused on improving a small-sized antenna structure applied to multi-band designs so as to solve the prior problems.

Figure 1:
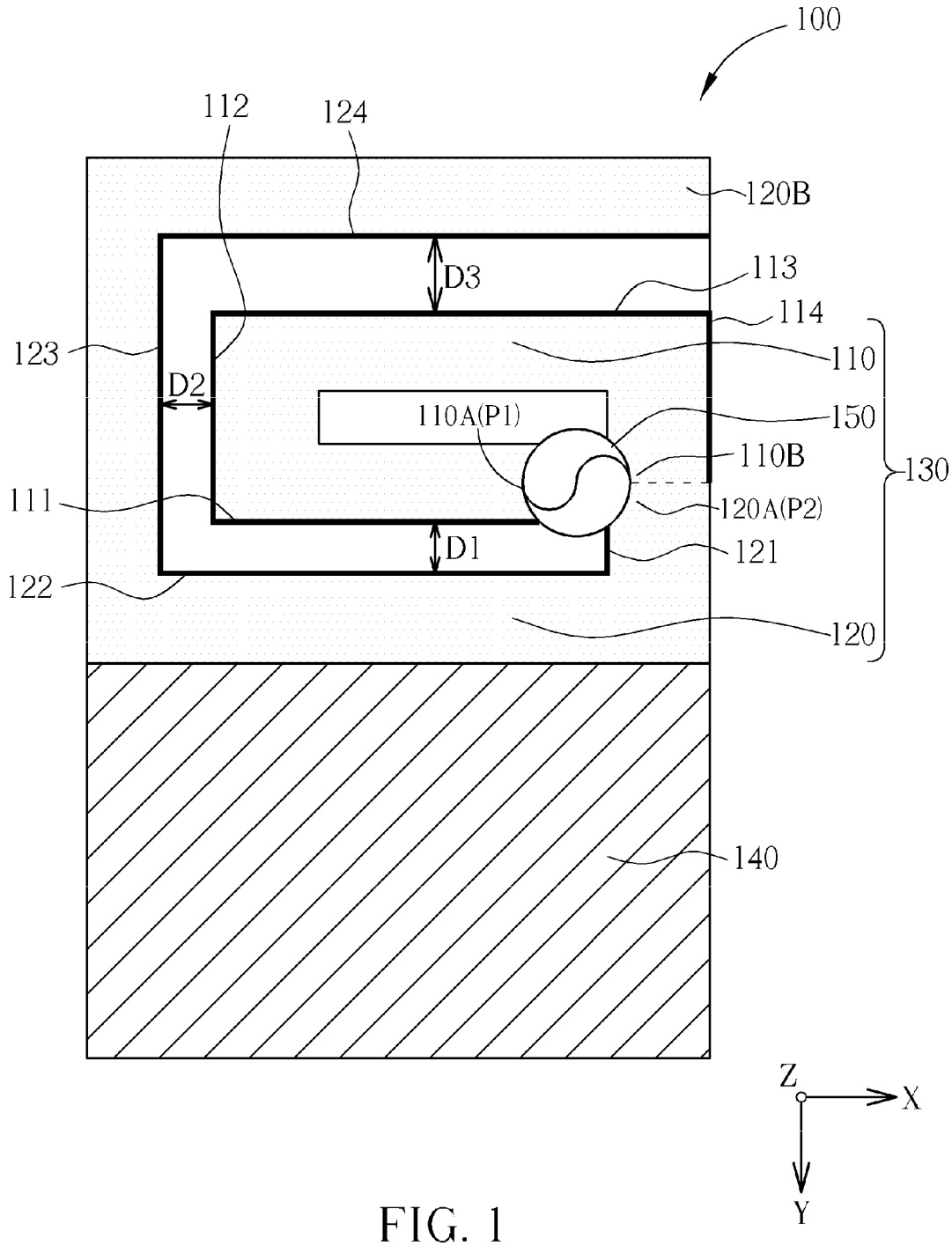
FIG. 1 is a diagram of an antenna structure according to a first embodiment of the present invention.
Figure 2:
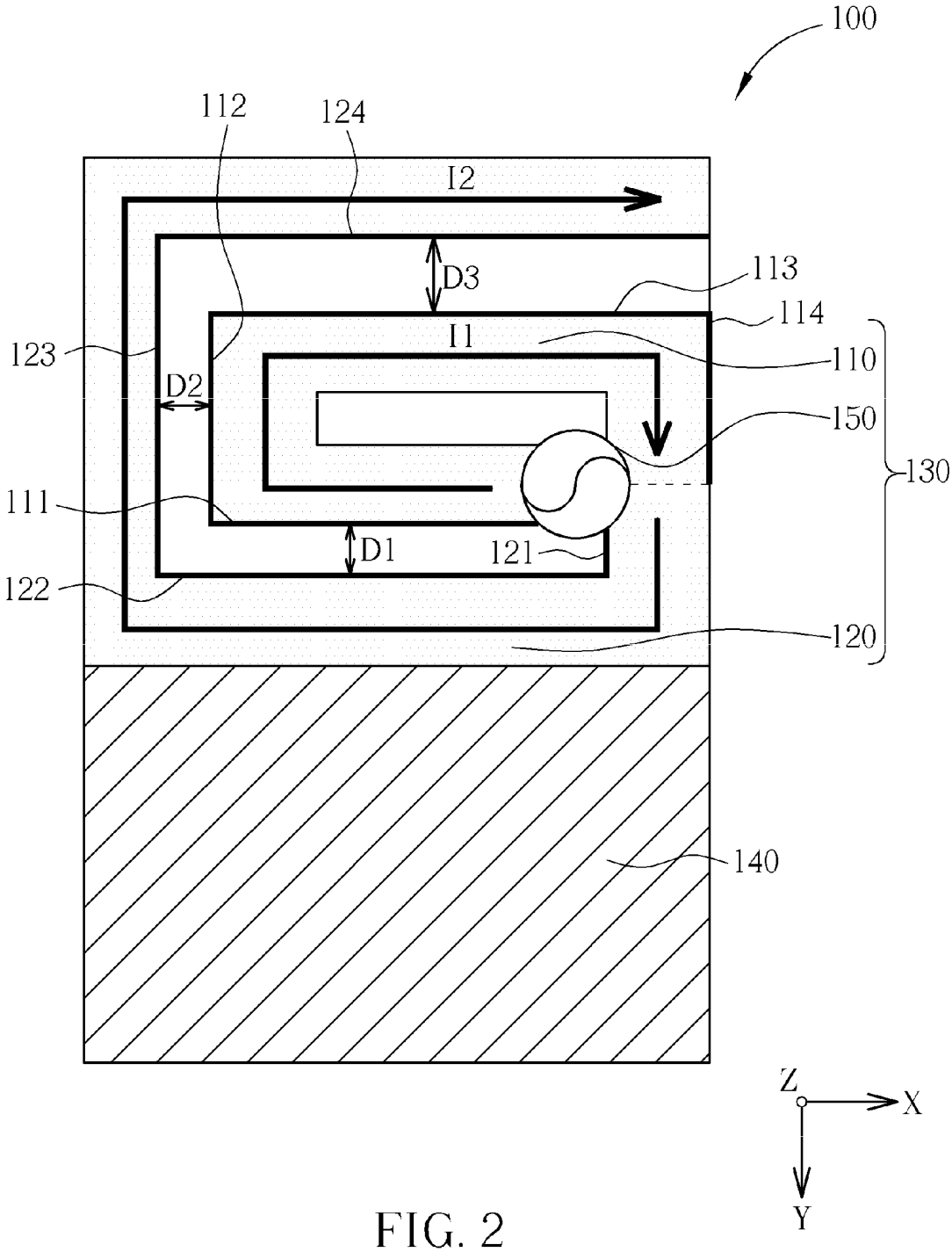
FIG. 2 is a diagram illustrating current paths of the antenna structure shown in FIG. 1.

Please refer to FIG. 1 together with FIG. 2. FIG. 1 is a diagram of an antenna structure 100 according to a first embodiment of the present invention, and FIG. 2 is a diagram illustrating current paths of the antenna structure 100 shown in FIG. 1. As shown in FIG. 1, the antenna structure 100 includes, but is not limited to, a radiation element 130, a grounding element 140, a positive feeding point P1 and a negative feeding point P2. The radiation element 130 includes a first radiator 110 and a second radiator 120. The first radiator 110 has a first end 110A and a second end 110B, wherein the first end 110A is coupled to the positive feeding point P1. The second radiator 120 also has a first end 120A and a second end 120B, wherein the first end 120A is coupled to the negative feeding point P2. The grounding element 140 is coupled to the second radiator 120. Furthermore, a feeding signal source 150 is used for exciting the antenna structure 100, wherein a positive signal terminal of the feeding signal source 150 is coupled to the positive feeding point P1 (i.e., the first end 110A of the first radiator 110), and a negative signal terminal of the feeding signal source 150 is coupled to the negative feeding point P2 (i.e., the first end 120A of the second radiator 120).

Pleas keep referring to FIG. 1. The first radiator 110 has a plurality of first side edges 111~114, and the second radiator 120 has a plurality of second side edges 121~124. In this embodiment, the first radiator 110 includes a plurality of segments, and each of the segments has an inside edge as well as an outside edge. In FIG. 1, bold lines are used for representing the plurality of outside edges of the first radiator 110 (i.e., the first side edges 111~114), and thin lines are used for representing the plurality of inside edges of the first radiator 110. In addition, the second radiator 120 also includes a plurality of segments, and each of the segments also has an inside edge as well as an outside edge. In FIG. 1, bold lines are used for representing the plurality of inside edges of the second radiator 120 (i.e., the second side edges 121~124), and the thin lines are used for representing the plurality of outside edges of the second radiator 120. What calls for special attention is that the second radiator 120 at least partially surrounds the first radiator 110, and there are a plurality of predetermined gaps D1, D2, and D3 existed in between the plurality of first side edges 111~114 of the first radiator 110 and the plurality of second side edges 121~124 of the second radiator 120 to form coupling effects (or called as capacitance effects).

Please note that the abovementioned term "surround" does not mean that the second radiator 120 must completely encompass the first radiator 110, but it could mean that the second radiator 120 is disposed in parts of the surroundings of the first radiator 110.

As shown in FIG. 2, a first current I1 flows through the first radiator 110 along the plurality of first side edges 111~114; and a second current I2 flows through the second radiator 120 along the plurality of second side edges 121~124. Moreover, the first current I1 flows from the positive signal terminal of the feeding signal source 150 to the negative signal terminal of the feeding signal source 150, that is to say, a current path of the first current I1 flowing through the plurality of segments of the first radiator 110 constitutes a loop.

Be noted that in this embodiment, the first radiator 110 can be viewed as a wrap-around antenna, which resonates at a first operating frequency band (such as, the operating frequency band BW1 shown in FIG. 3) corresponding to a first resonance mode by making use of the current path caused by surround effects (i.e., the first current I1); and the second radiator 120 resonates at a second operating frequency band (such as, the operating frequency band BW2 shown in FIG. 3) corresponding to a second resonance mode by making use of the current path caused by coupling effects or capacitance effects (i.e., the second current I2). Furthermore, the first radiator 110 and the second radiator 120 form a spiral, and the plurality of predetermined gaps D1, D2, and D3 above form a spiral space. In other words, the first radiator 110 and the second radiator 120 are disposed around along the spiral space.

Figure 3:
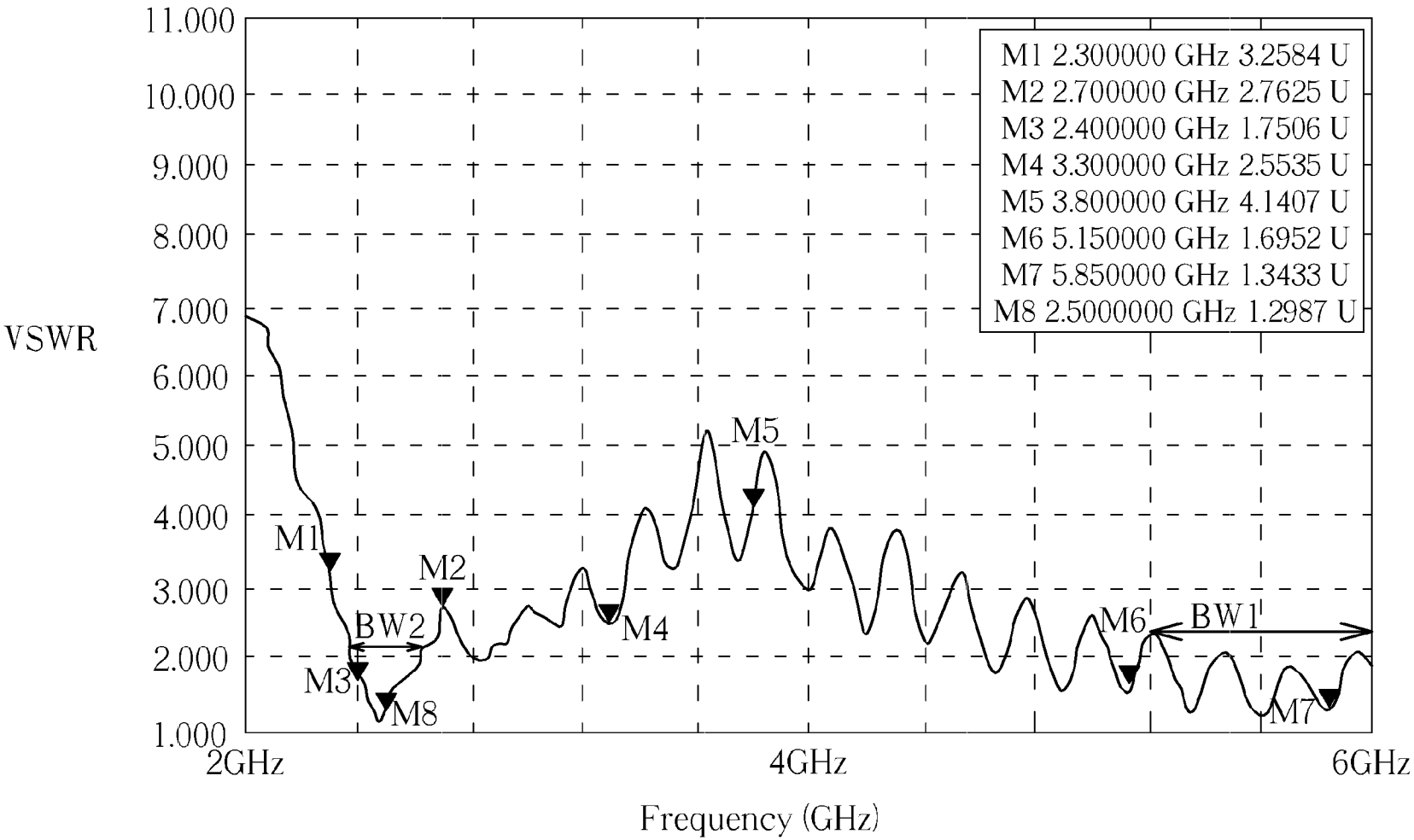
FIG. 3 is a diagram illustrating the VSWR of the antenna structure shown in FIG. 1.

Please refer to FIG. 3. FIG. 3 is a diagram illustrating the VSWR of the antenna structure shown in FIG. 1. The horizontal axis represents frequency (GHz), between 2 GHz and 6 GHz, and the vertical axis represents the VSWR. As can be known from FIG. 3, the antenna structure 100 has a first resonance mode and a second resonance mode, wherein the first operating frequency band BW1 corresponding to the first resonance mode is from about 5.15 GHz to 5.85 GHz, and the second operating frequency band BW2 corresponding to the second resonance mode is from about 2.4 GHz to 2.5 GHz.

Figure 4:
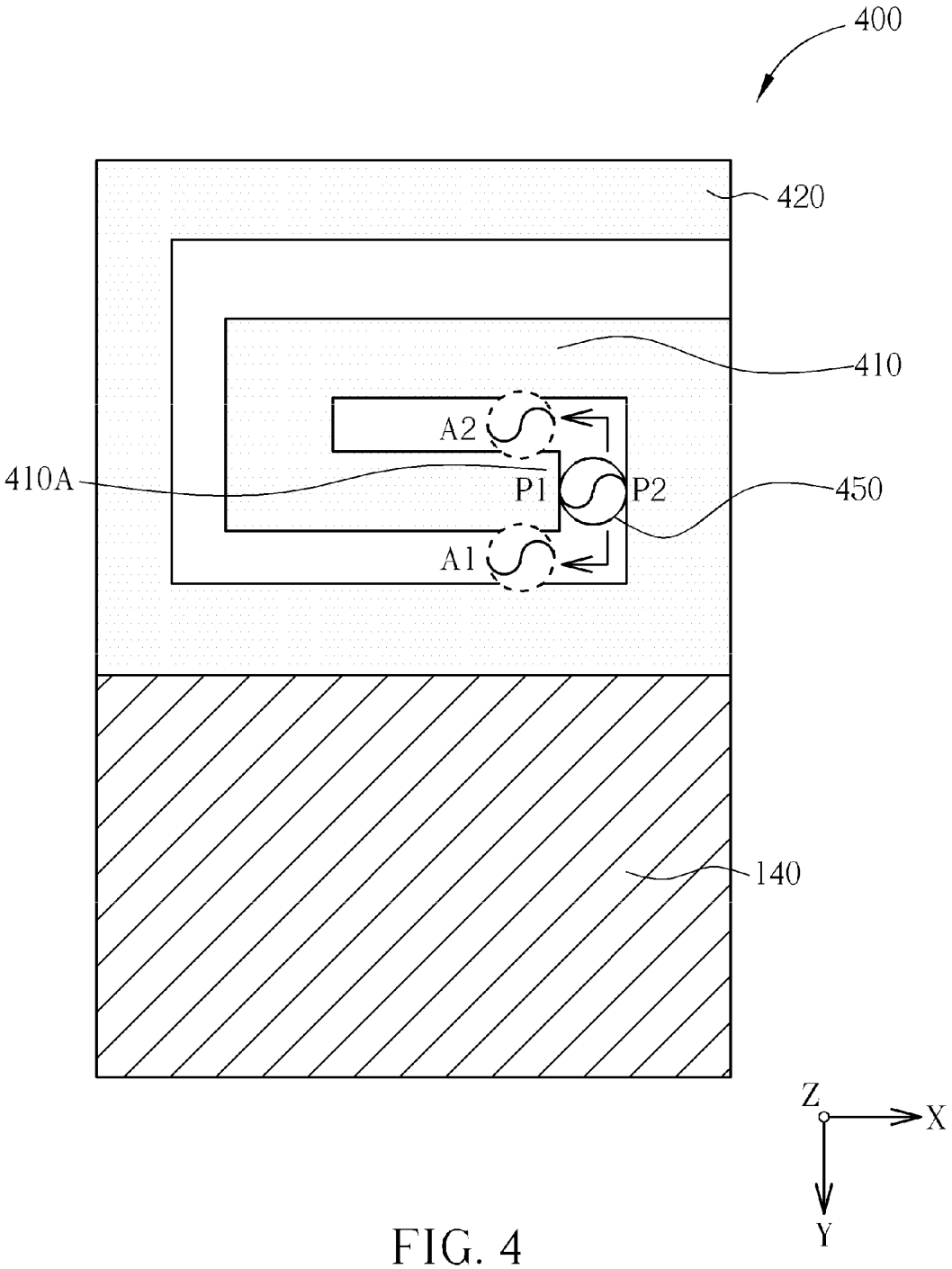
FIG. 4 is a diagram of an antenna structure according to a second embodiment of the present invention.
Figure 5:
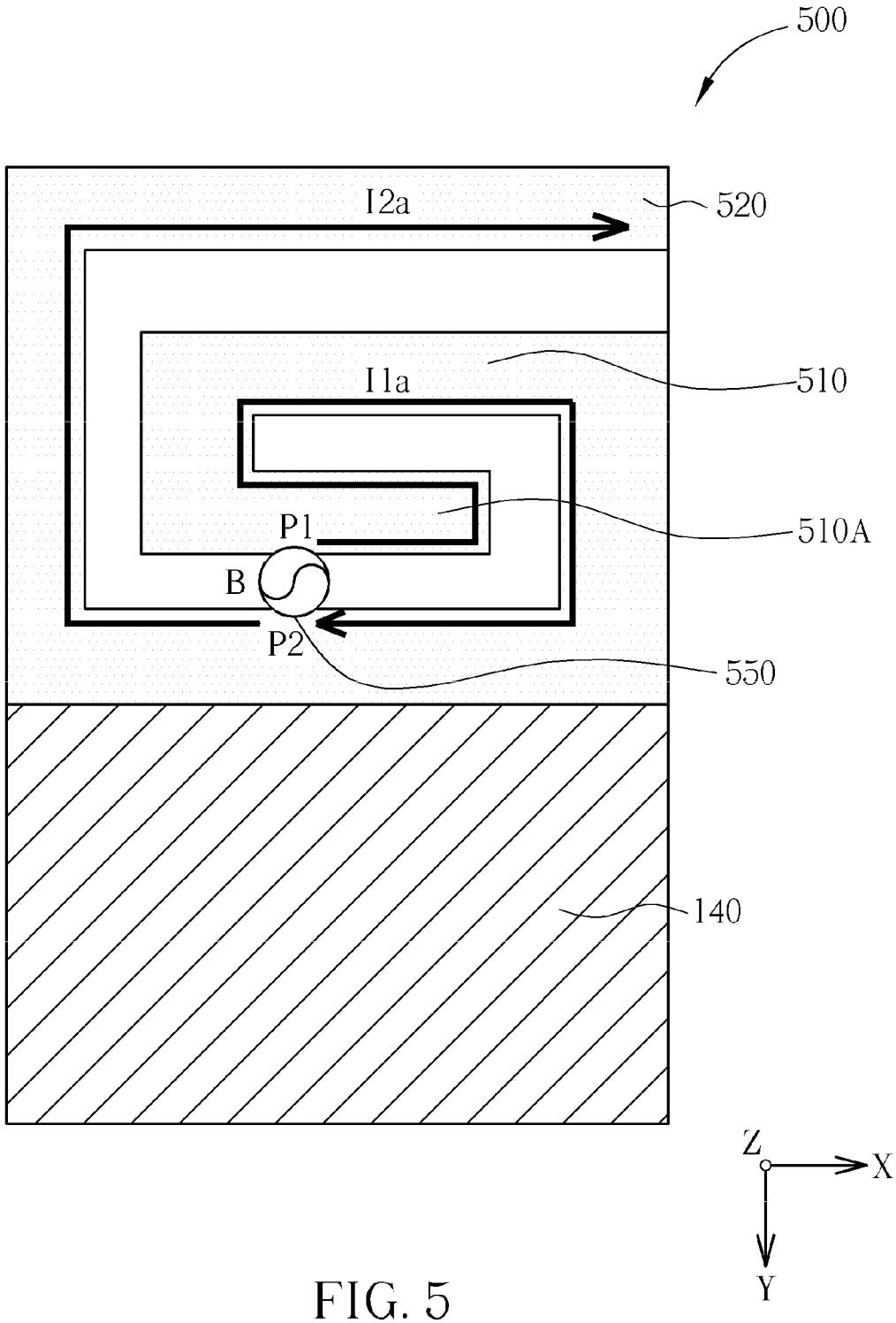
FIG. 5 is a diagram showing a varied embodiment of the antenna structure shown in FIG. 4.
Figure 6:
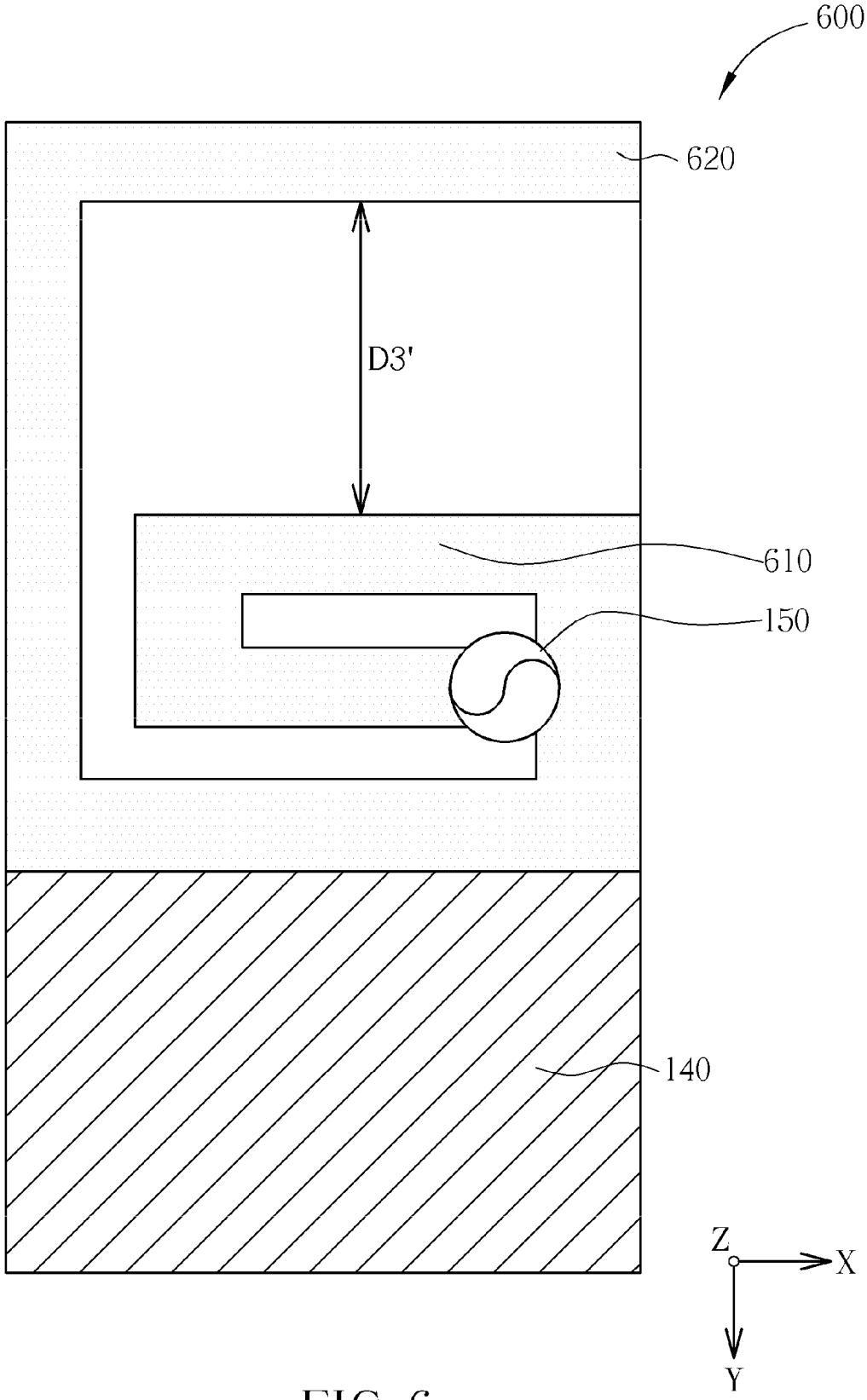
FIG. 6 is a diagram of an antenna structure according to a third embodiment of the present invention.
Figure 7:
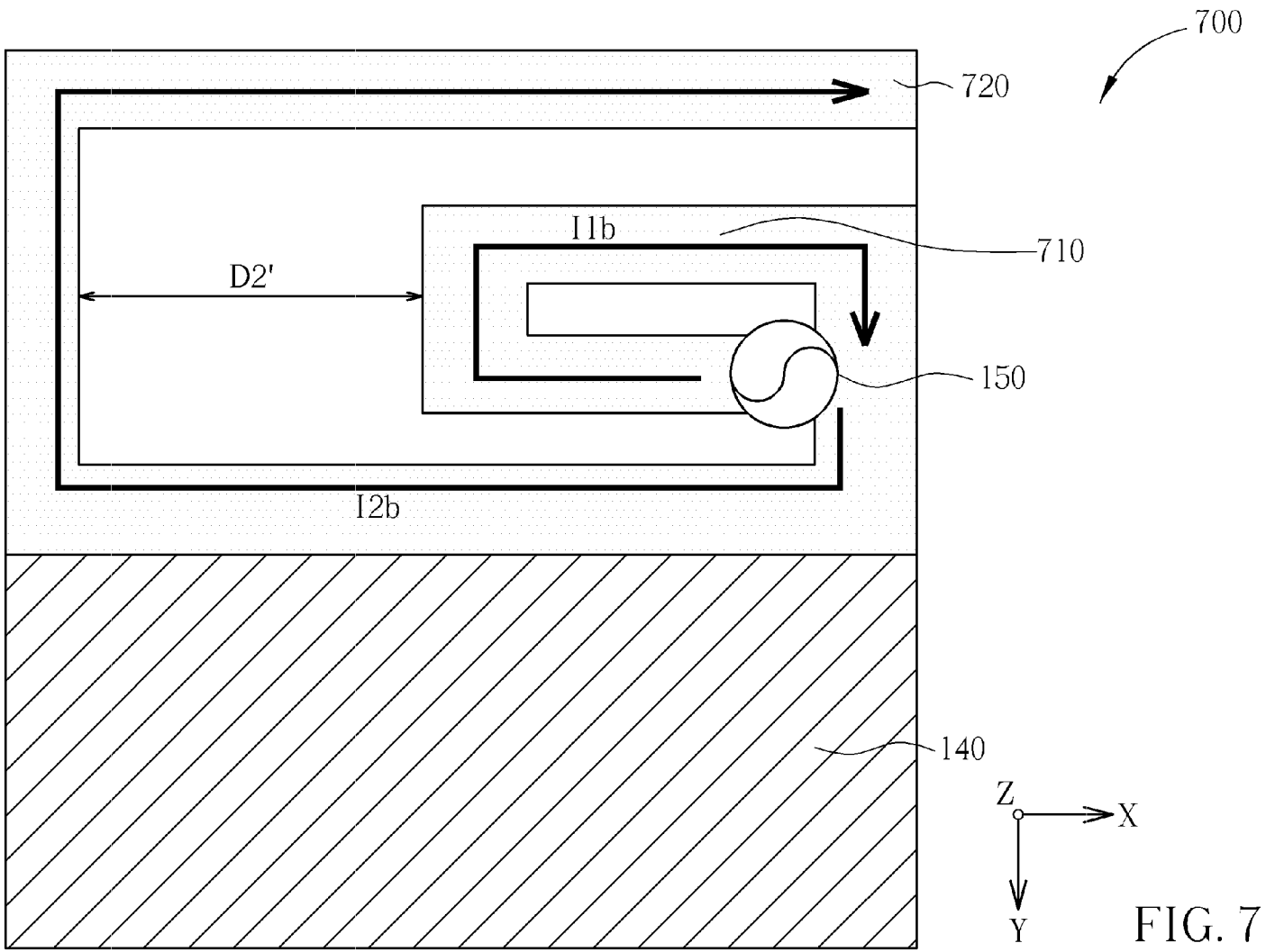
FIG. 7 is a diagram of an antenna structure according to a fourth embodiment of the present invention.
Figure 8:
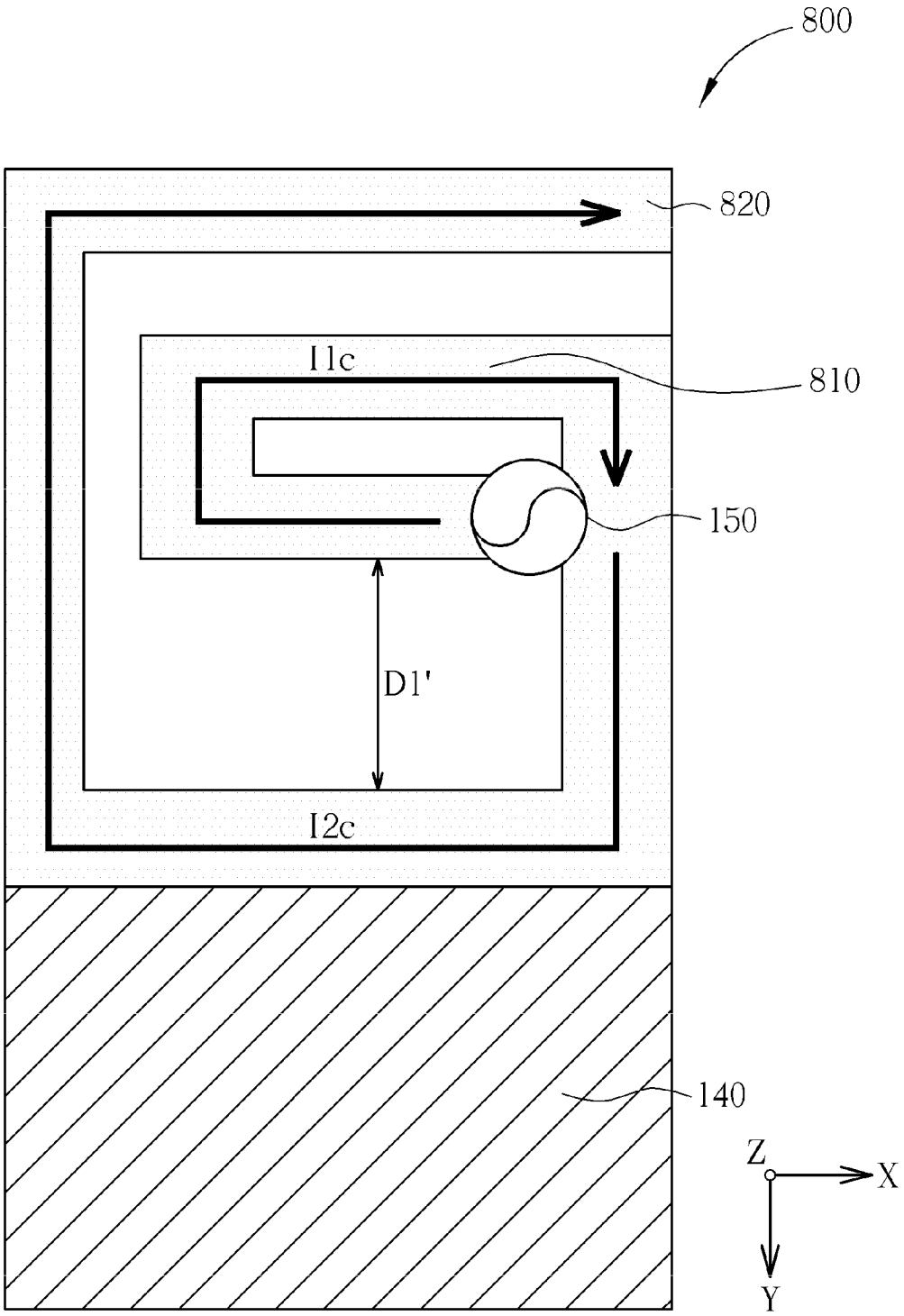
FIG. 8 is a diagram of an antenna structure according to a fifth embodiment of the present invention.
Figure 10:
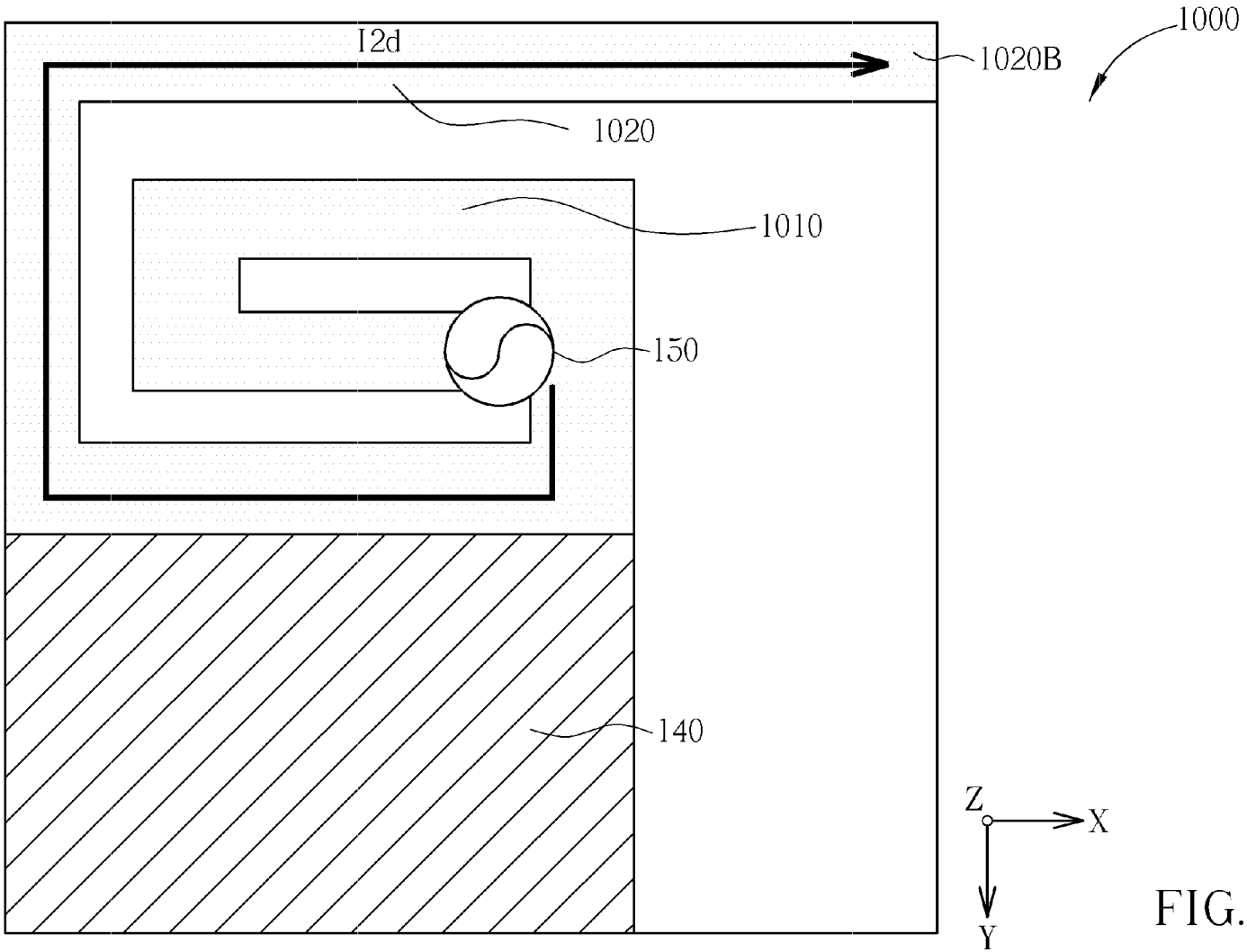
FIG. 10 is a diagram of an antenna structure according to a seventh embodiment of the present invention.
Figure 11:
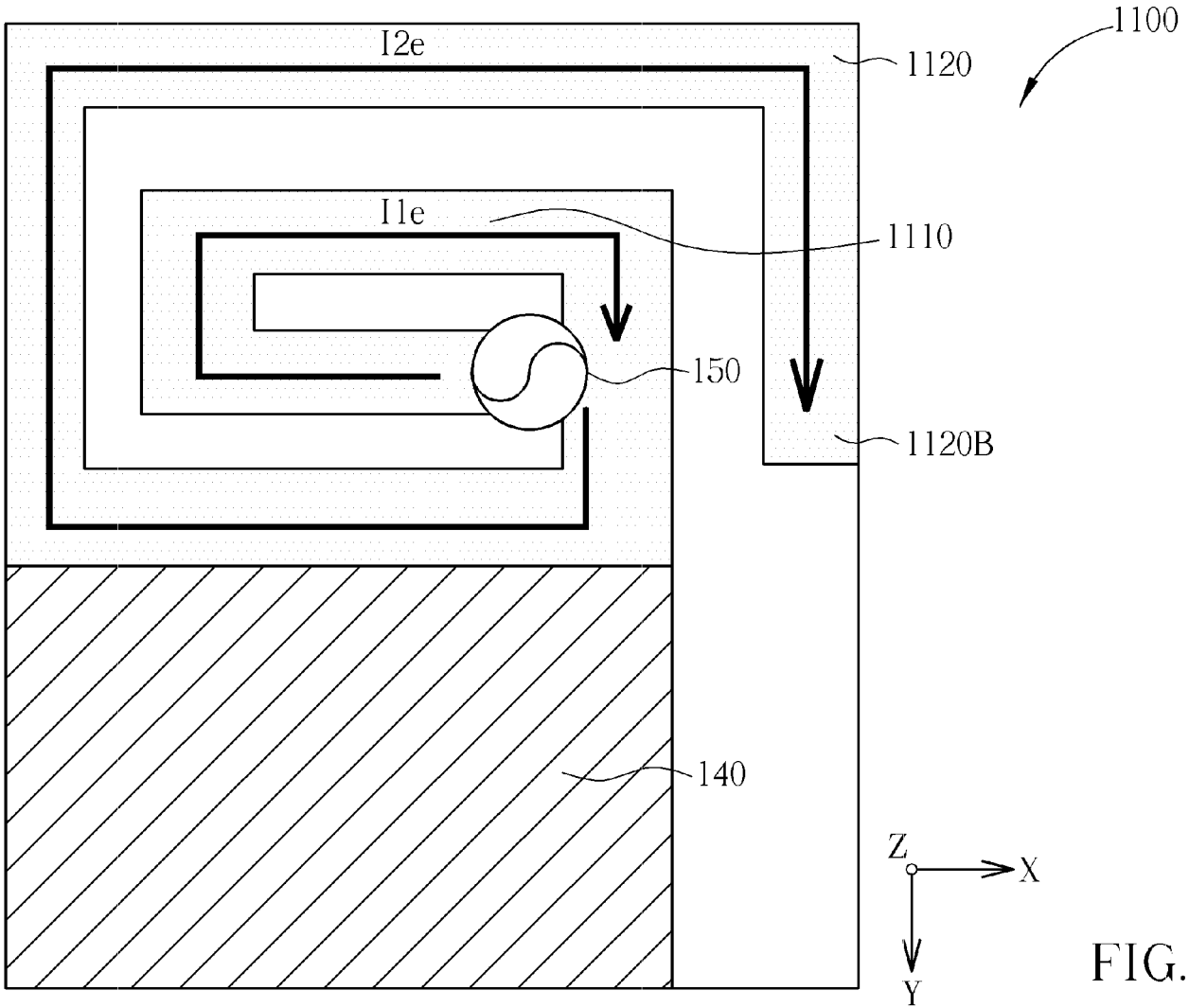
FIG. 11 is a diagram of an antenna structure according to an eighth embodiment of the present invention.
Figure 12:
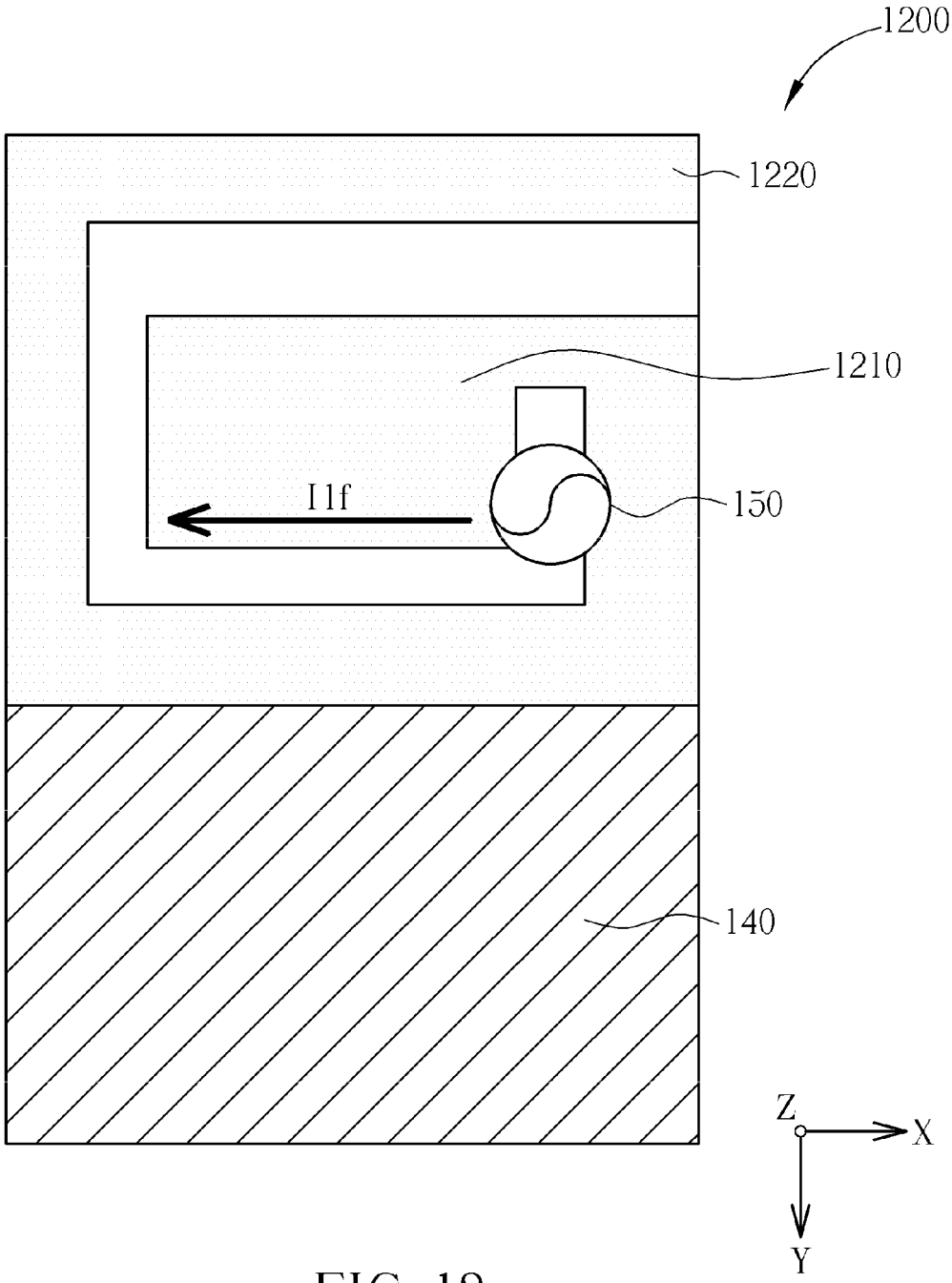
FIG. 12 is a diagram of an antenna structure according to a ninth embodiment of the present invention.
Figure 13:
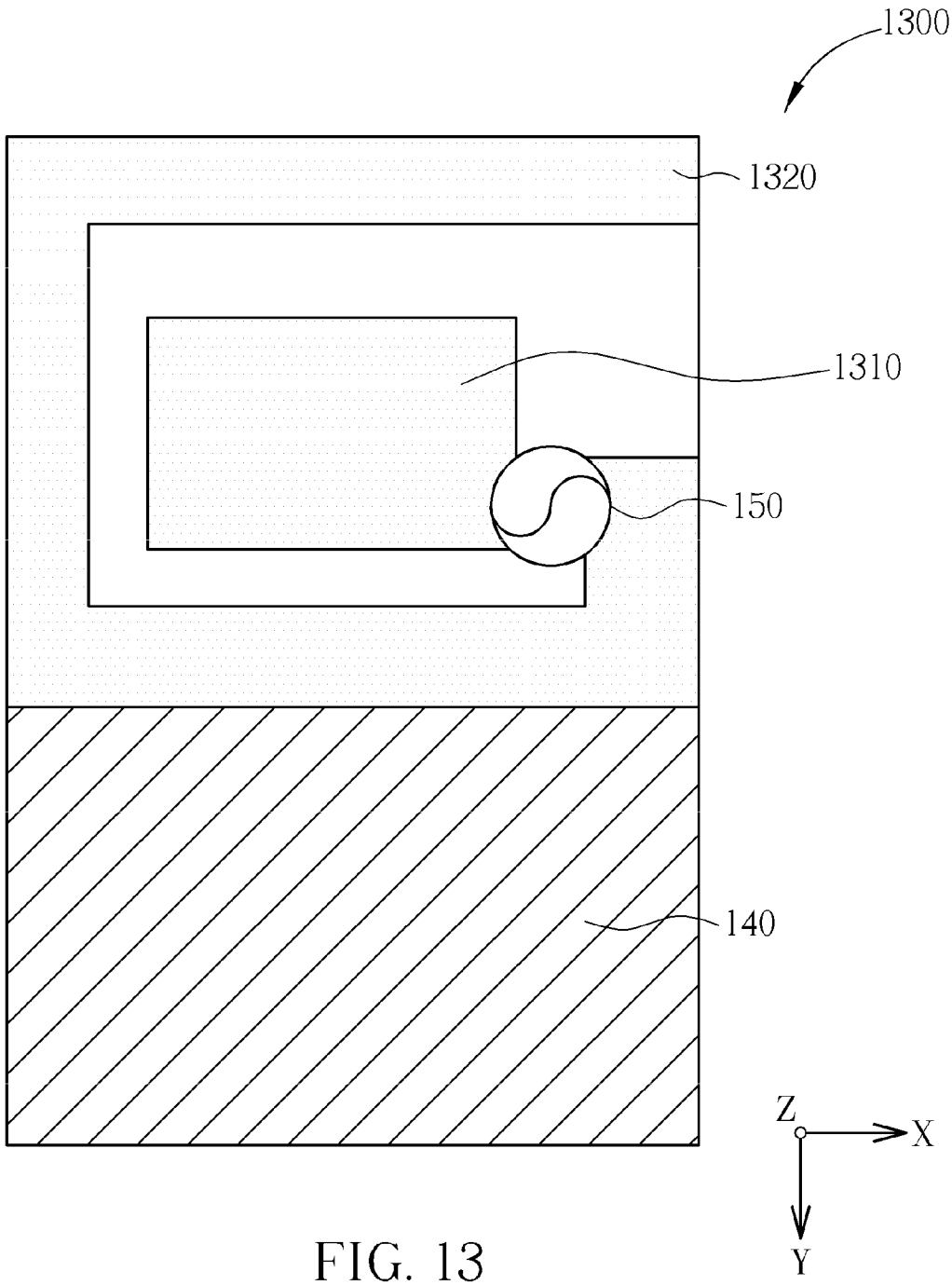
FIG. 13 is a diagram of an antenna structure according to a tenth embodiment of the present invention.
Figure 14:
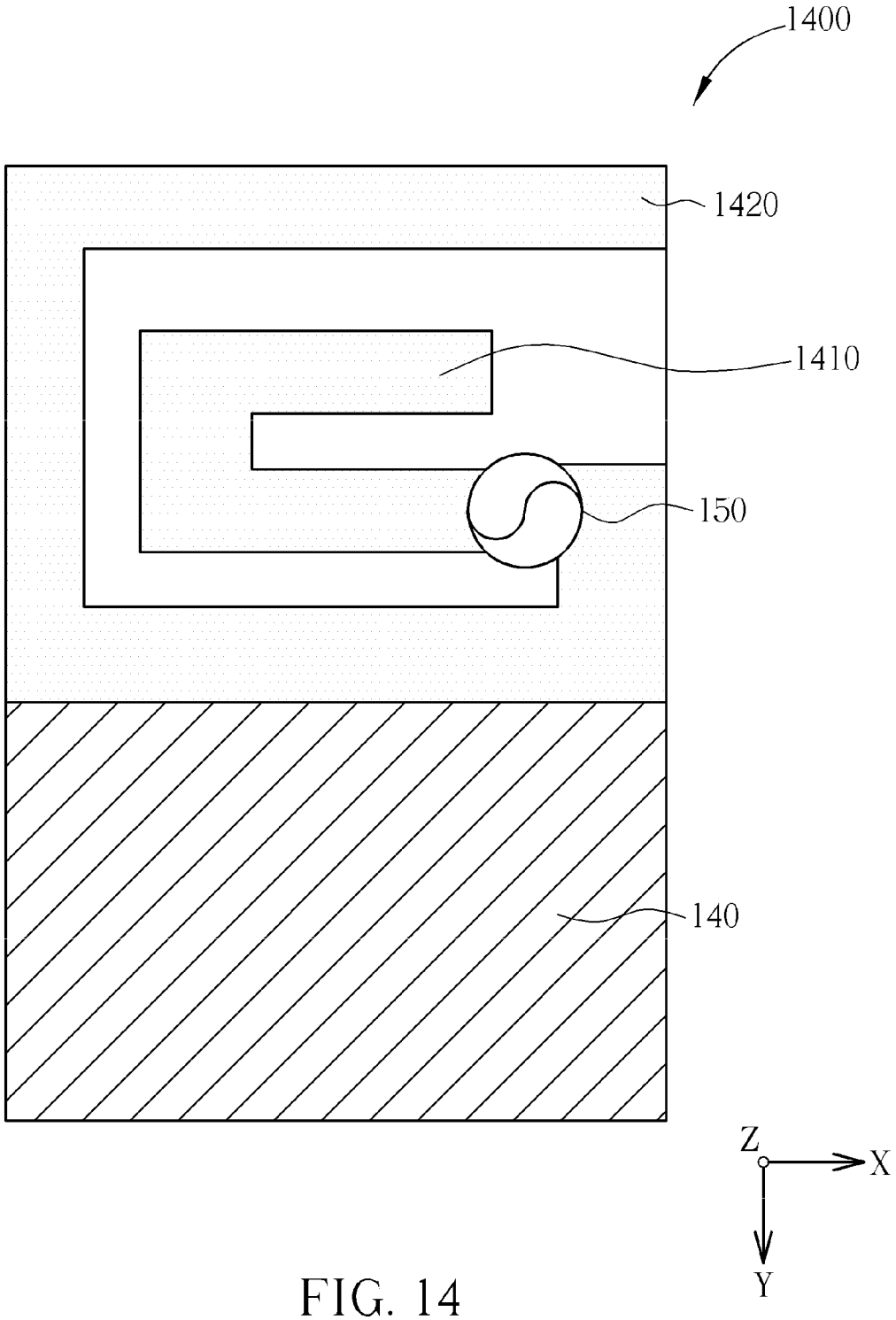
FIG. 14 is a diagram of an antenna structure according to an eleventh embodiment of the present invention.

Certainly, the antenna structure 100 shown in FIG. 1 is merely an embodiment of the present invention, and those skilled in the art should appreciate that various modifications of the antenna structure 100 may be made without departing from the spirit of the present invention. In the following descriptions, practicable varied embodiments of the antenna structure 100 are used for illustrations. Herein FIG. 4 and FIG. 5 are varied embodiments making descriptions of changing positions of the positive feeding point and the negative feeding point; FIG. 6, FIG. 7, and FIG. 8 are varied embodiments making descriptions of changing the predetermined gaps of the antenna structure; FIG. 10 and FIG. 11 are varied embodiments making descriptions of changing the second radiator; FIG. 12, FIG. 13, and FIG. 14 are varied embodiments making descriptions of changing the first radiator; and FIG. 15A, FIG. 15B, FIG. 16A, and FIG. 16B are varied embodiments making descriptions of disposing the first radiator and the second radiator on different planes.

Please refer to FIG. 4 together with FIG. 5. FIG. 4 and FIG. 5 are diagrams respectively showing varied embodiments of an antenna structure according to the present invention. As can be known from FIG. 4, the positions of the positive signal terminal (which is also coupled to the positive feeding point P1) and the negative signal terminal (which is also coupled to the negative feeding point P2) of the feeding signal source 450 are not unchangeable, and the position of the feeding signal source 450 can be moved to any one location in between the locations A1-A2 (which is close to a first end 410A of the first radiator 410) by reference to the directions indicated by arrows shown in FIG. 4. In other words, the positions of the positive feeding point P1 and the negative feeding point P2 mentioned above can be adjusted depending on actual applications. What calls for special attention is that by changing the positions of the positive feeding point P1 and the negative feeding point P2, the current paths flowing through the first radiator 410 and the second radiator 420 of the antenna structure 400 will be changed. In addition, since the lengths of the current paths are changed, the operating frequency bands of the first radiator 410 and the second radiator 420 will be affected. For example, in FIG. 5, if the feeding signal source 550 is moved to the position B, which is far from a first end 510A of a first radiator 510, current paths of a first current I1*a* flowing through the first radiator 510 and a second current I1*a* flowing through the second radiator 520 will have a large change in their lengths.

Please refer to FIG. 6, FIG. 7, together with FIG. 8. FIG. 6, FIG. 7, and FIG. 8 are respectively a diagram showing another varied embodiment of an antenna structure according to the present invention. In FIG. 6, the architecture of the antenna structure 600 is similar to that of the antenna structure 100 shown in FIG. 1 and is a change form of the antenna structure 100. Be noted that the difference between them is that a predetermined gap D3' in between a first radiator 610 and a second radiator 620 of the antenna structure 600 is greater than the predetermined gap D3 of the antenna structure 100 shown in FIG. 1. In other words, the predetermined gap D3/D3' can be adjusted depending on actual applications. What calls for special attention is that: the coupling effects get poor as the predetermined gap D3/D3' gets larger, which leads the higher operating frequency band (i.e., the first operating frequency band BW1) to have a narrower bandwidth as well.

In FIG. 7, the architecture of the antenna structure 700 is similar to that of the antenna structure 100 shown in FIG. 1. Be noted that the difference between them is that a predetermined gap D2' in between a first radiator 710 and a second radiator 720 of the antenna structure 700 is greater than the predetermined gap D2 of the antenna structure 100 shown in FIG. 1. In other words, the predetermined gap D2/D2' can be adjusted depending on actual applications. What calls for special attention is that: the bandwidth of the higher operating frequency band (i.e., the first operating frequency band BW1) won't be affected as the predetermined gap D2/D2' gets larger. However, since a current path 12*b* of the lower operating frequency band (i.e., the second operating frequency band BW2) gets longer, it will lead the lower operating frequency band to have a lower frequency.

In FIG. 8, the architecture of the antenna structure 800 is similar to that of the antenna structure 100 shown in FIG. 1. Be noted that the difference between them is that a predetermined gap D1' in between a first radiator 810 and a second radiator 820 of the antenna structure 800 is greater than the predetermined gap D1 of the antenna structure 100 shown in FIG. 1. In other words, the predetermined gap D1/D1' can be adjusted depending on actual applications. What calls for special attention is that: the coupling effects get poor as the predetermined gap D1/D1' gets larger, which leads the higher operating frequency band (i.e., the first operating frequency band BW1) to have a mismatch impedance as well. Additionally, since a current path 12*c* of the lower operating frequency band (i.e., the second operating frequency band BW2) gets longer, it will lead the lower operating frequency band to have a lower frequency.

Figure 9:
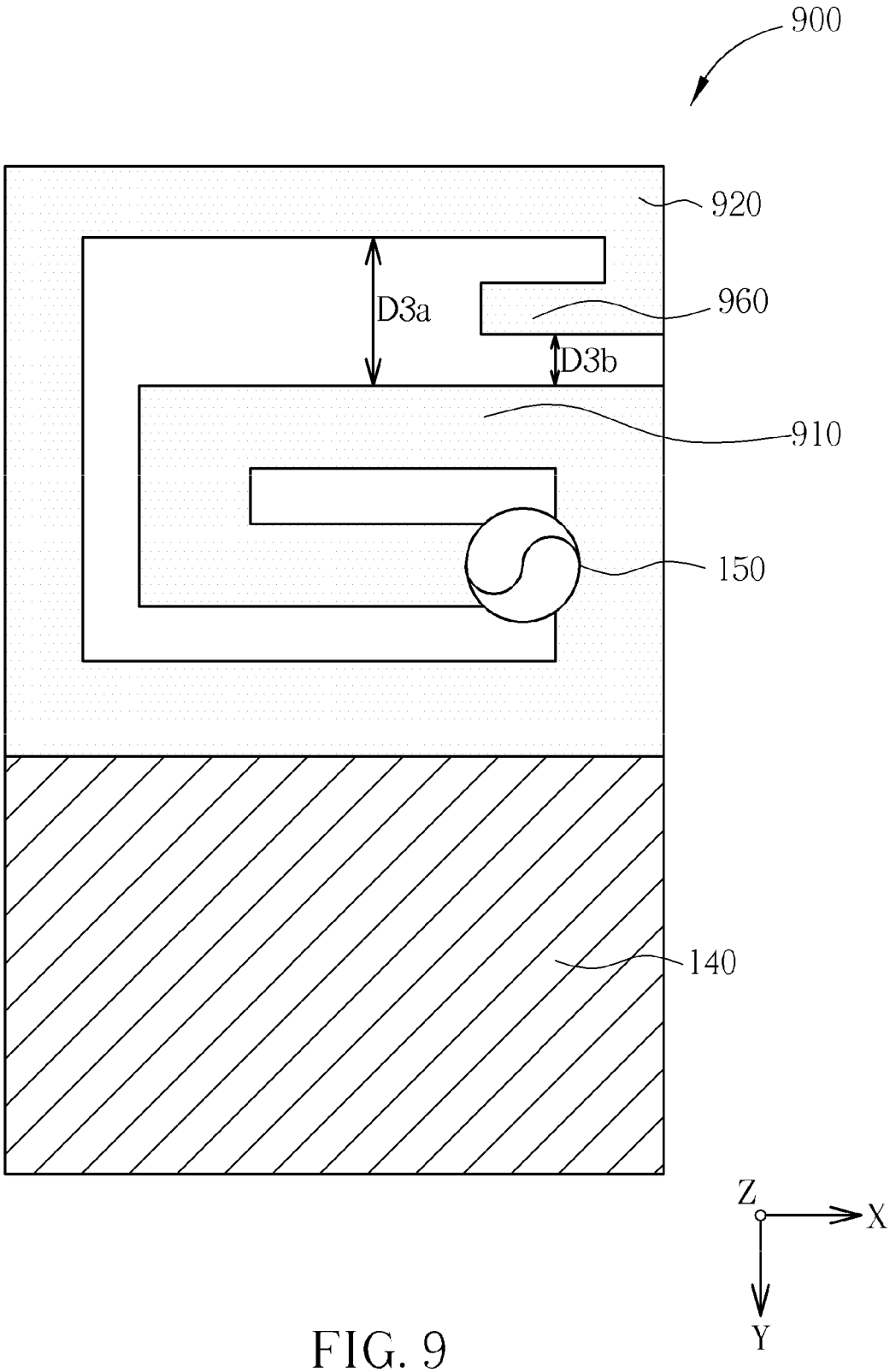
FIG. 9 is a diagram of an antenna structure according to a sixth embodiment of the present invention.

Please refer to FIG. 9, FIG. 10 together with FIG. 11. FIG. 9, FIG. 10, and FIG. 11 are respectively a diagram showing another varied embodiment of an antenna structure according to the present invention. In FIG. 9, the architecture of the antenna structure 900 is similar to that of the antenna structure 100 shown in FIG. 1, and the difference between them is that there is a bend 960 existed close to the second end of a second radiator 920 of the antenna structure 900. As a result, two predetermined gaps D3*a* and D3*b* existed in between the first radiator 910 and the second radiator 920 have different sizes. As the predetermined gap D3*b* of the antenna structure 900 is smaller than the predetermined gap D3 of the antenna structure 100, the coupling effects resulted from the predetermined gap D3*b* get stronger.

In FIG. 10, the architecture of the antenna structure 1000 is similar to that of the antenna structure 100 shown in FIG. 1. The antenna structure 1000 includes a first radiator 1010 and a second radiator 1020, and the difference between them is that a second end 1020B of the second radiator 1020 in the antenna structure 1000 is further extended toward the positive X-axis. Furthermore, since a current path of the second current I2*d* flowing through the second radiator 1020 gets longer, it will lead the lower operating frequency band to have a lower frequency.

In FIG. 11, the architecture of the antenna structure 1100 is similar to that of the antenna structure 100 shown in FIG. 1, and the difference between them is that a second end 1120B of a second radiator 1120 in the antenna structure 1100 is further extended toward the negative Y-axis. Furthermore, since a current path of the second current I2*e* flowing through the second radiator 1120 gets longer, it will lead the lower operating frequency band to have a lower frequency. Besides, a first current I1*e* flowing through its first radiator 1110 will be affected, which leads the higher operating frequency band to have a mismatch impedance as well.

Please refer to FIG. 12, FIG. 13 together with FIG. 14. FIG. 12, FIG. 13, and FIG. 14 are respectively a diagram showing another varied embodiment of an antenna structure according to the present invention. In FIG. 12, the architecture of the antenna structure 1200 is similar to that of the antenna structure 100 shown in FIG. 1. The antenna structure 1200 includes a first radiator 1210 and a second radiator 1220, and the difference between them is that the first radiator 1210 of the antenna structure 1200 is not a wrap-around antenna and should be viewed as a shorted monopole antenna. Furthermore, since the current path of a first current I1*f* flowing through the first radiator 1210 gets shorter, it will lead the higher operating frequency band to have an increased frequency.

In FIG. 13, the architecture of the antenna structure 1300 is similar to that of the antenna structure 1200 shown in FIG. 12, and the difference between them is that a first radiator 1310 and a second radiator 1320 of the antenna structure 1300 are not electronically connected together. In this embodiment, the first radiator 1310 is viewed as a monopole antenna.

In FIG. 14, the architecture of the antenna structure 1400 is similar to that of the antenna structure 100 shown in FIG. 1, and the difference between them is that a first radiator 1410 and a second radiator 1420 of the antenna structure 1400 are not electronically connected together. In this embodiment, the first radiator 1410 is viewed as a monopole antenna.

Please note that the aforementioned embodiments shown in FIG. 1~FIG. 14 are focused on a condition that both the first radiator and the second radiator are located on the same plane (i.e., the same XY plane), but this in no way should be considered as limitations of the present invention. In other embodiments, the first radiator and the second radiator can be disposed on different planes so as to achieve a goal of multi-band designs.

Figure 15A:
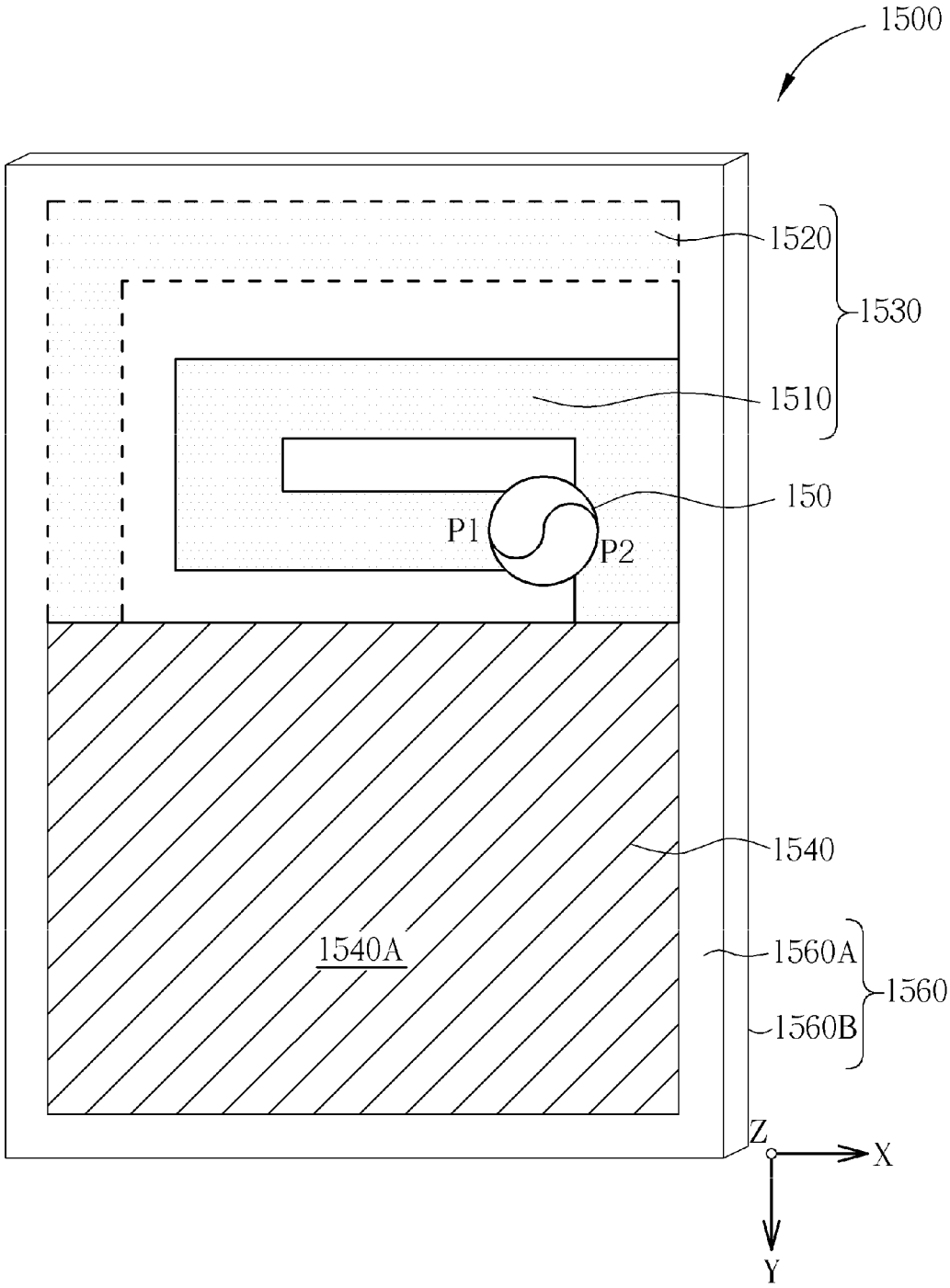
FIG. 15A is a top view of an antenna structure according to a twelfth embodiment of the present invention.
Figure 15B:
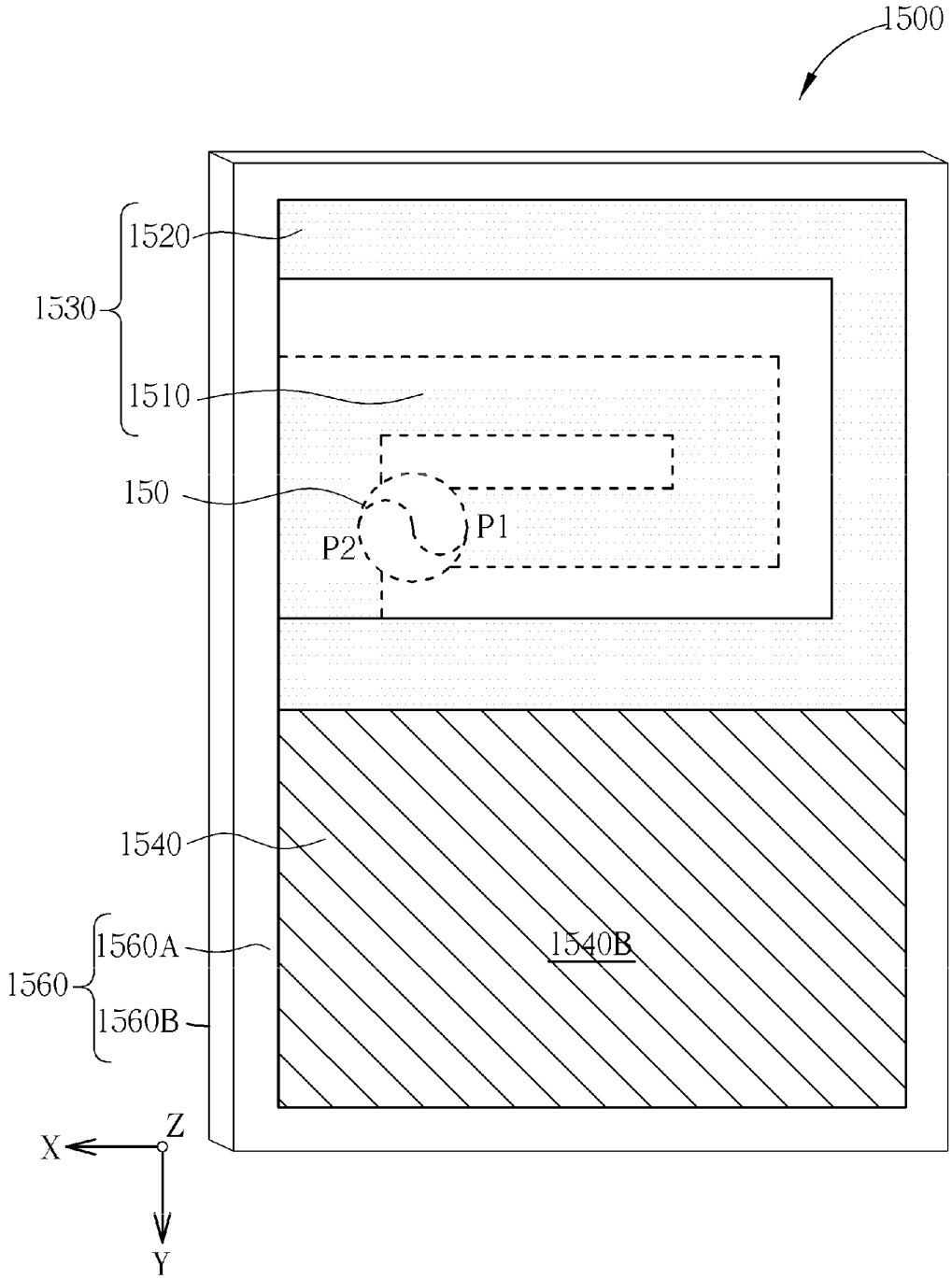
FIG. 15B is a back view of the antenna structure according to the twelfth embodiment of the present invention.

Please refer to FIG. 15A together with FIG. 15B. FIG. 15A and FIG. 15B are a top view and a back view of an antenna structure 1500 according to still another embodiment of the present invention, respectively. In this embodiment, the antenna structure 1500 includes a radiation element 1530, a grounding element 1540, a substrate 1560, the positive feeding point P1, and the negative feeding point P2. The substrate 1560 includes a first plane 1560A and a second plane 1560B opposite to the first plane 1560A. What calls for special attention is that the grounding element 1540 further includes a first grounding sub-element 1540A and a second grounding sub-element 1540B, and the first grounding sub-element 1540A at least overlaps the second grounding sub-element 1540B. Herein the first grounding sub-element 1540A as well as the first radiator 1510 are located on the first plane 1560A; and the second grounding sub-element 1540B as well as the second radiator 1520 are located on the second plane 1560B. In addition, the first grounding sub-element 1540A of the grounding element 1540 is coupled to the first radiator 1510; and the second grounding sub-element 1540B is coupled to the second radiator 1520.

Figure 16A:
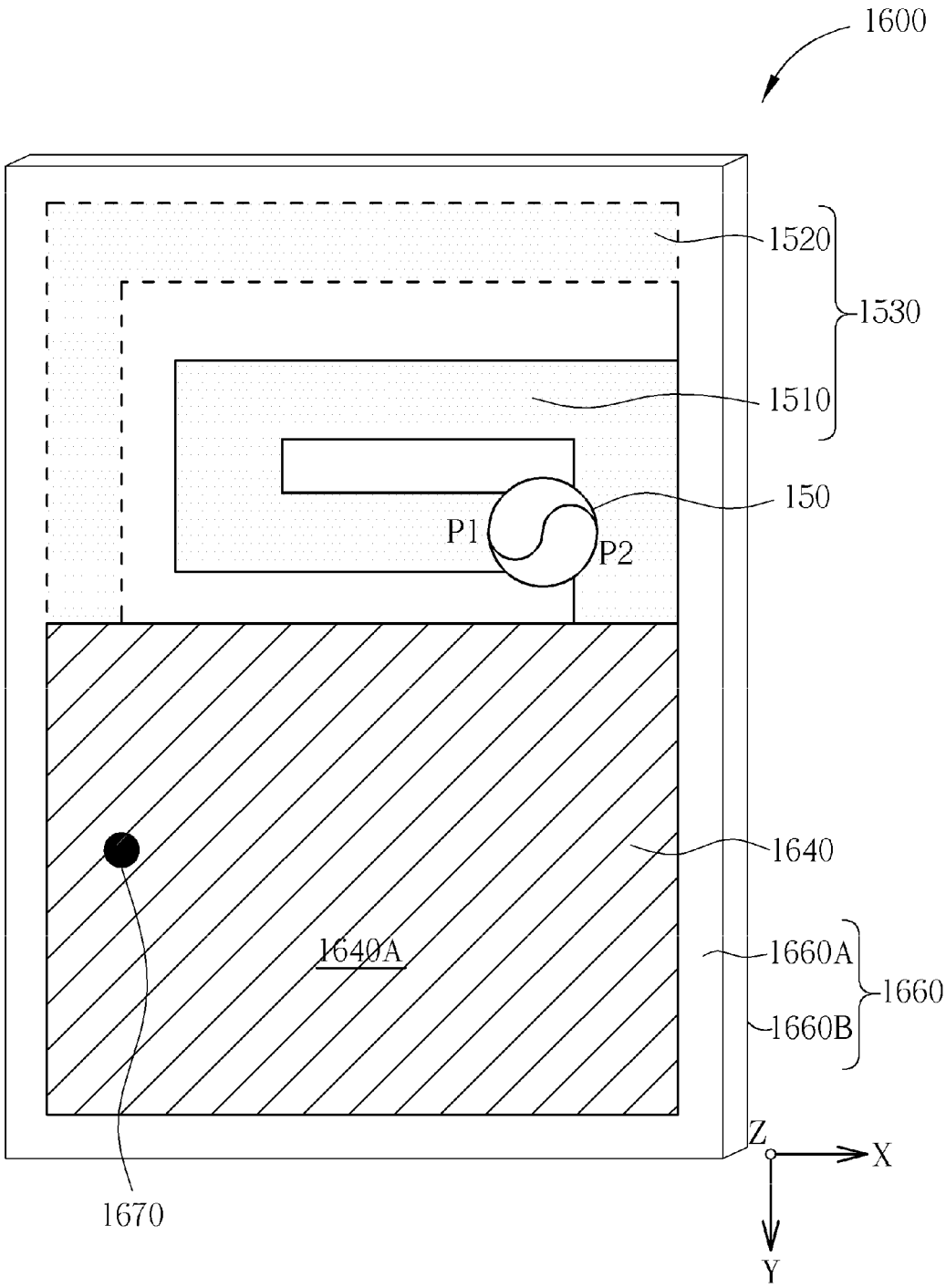
FIG. 16A is a top view of an antenna structure according to a thirteenth embodiment of the present invention.
Figure 16B:
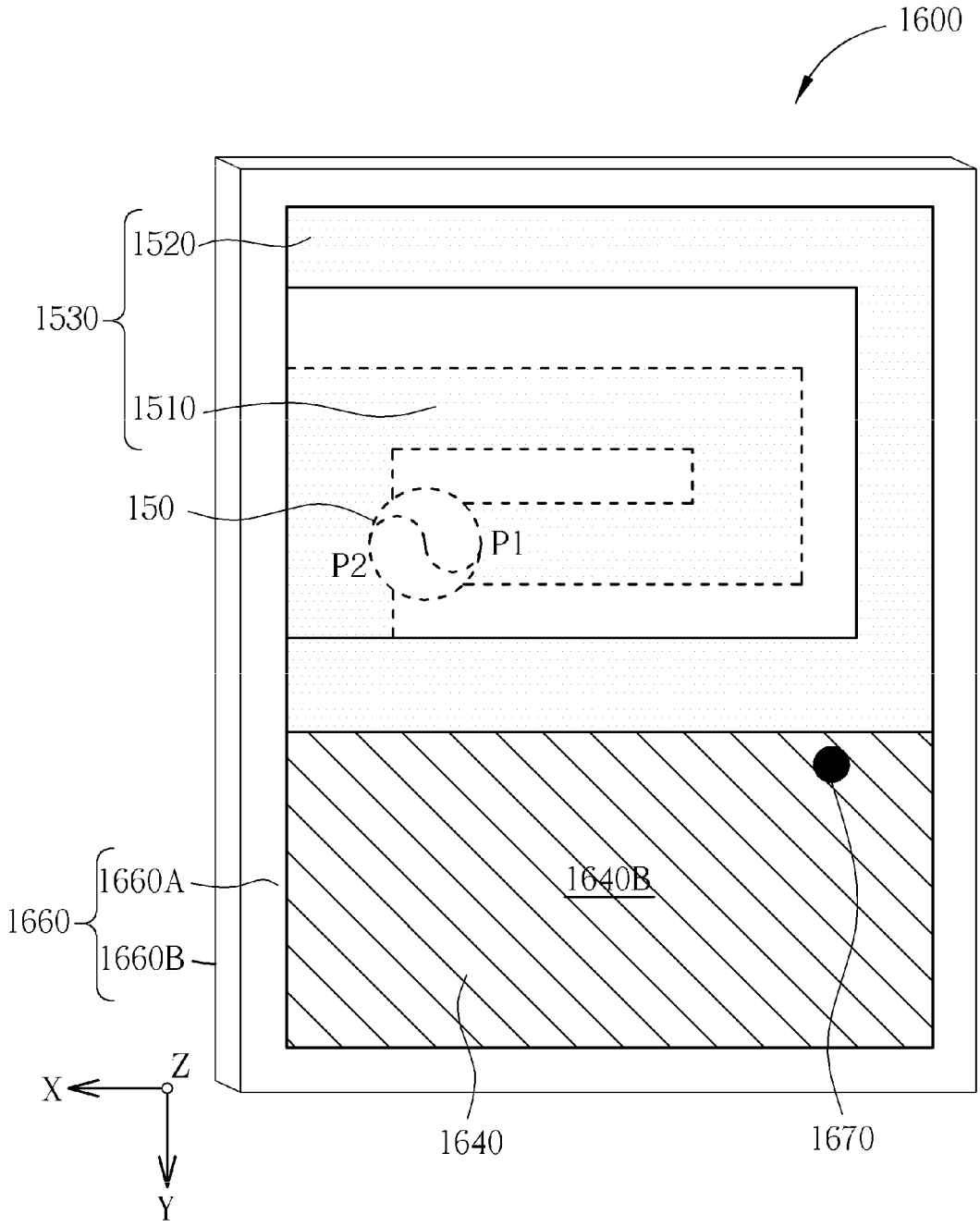
FIG. 16B is a back view of the antenna structure according to the thirteenth embodiment of the present invention.

Please refer to FIG. 16A together with FIG. 16B. FIG. 16A and FIG. 16B are a top view and a back view of an antenna structure 1600 according to still another embodiment of the present invention, respectively. The architecture of the antenna structure 1600 is similar to that of the antenna structure 1500, and the difference between them is that the antenna structure 1600 further includes a via hole 1670 disposed in between a first grounding sub-element 1640A and a second grounding sub-element 1640B of a grounding element 1640, and passing through a first plane 1660A and a second plane 1660B of the substrate 1660, for electronically connecting the first grounding sub-element 1640A with the second grounding sub-element 1640B.

The abovementioned embodiments are presented merely to illustrate practicable designs of the present invention, and in no way should be considered to be limitations of the scope of the present invention. Undoubtedly, those skilled in the art should appreciate that various modifications of the antenna structures 100-1600 shown in FIG. 1-FIG. 16A/FIG. 16B may be made without departing from the spirit of the present invention. For example, the antenna structures shown in FIG. 1-FIG. 16A/FIG. 16B can be arranged or combined randomly into a new varied embodiment.

From the above descriptions, the present invention provides an antenna structure (e.g., 100-1600) for surrounding a first radiator with a second radiator, so as to make coupling effects formed by a plurality of predetermined gaps existed in between first side edges of the first radiator and second side edges of the second radiator adjust impedance matching of the antenna structure. As a result, a multi-band goal can be achieved. Furthermore, various modifications of the antenna structure disclosed in the present invention may be made without departing from the spirit of the present invention. For example, the positions of the positive feeding point and the negative feeding point can be changed, the predetermined gaps between these two radiators can be changed, the shape of the first radiator and/or the shape of the second radiator can be changed, or the first radiator and the second radiator can be disposed on different planes, which also belongs to the scope of the present invention.

Those skilled in the art will readily observe that numerous modifications and alterations of the device and method may be made while retaining the teachings of the invention.

What is claimed is:

1. An antenna structure, comprising:

a positive feeding point and a negative feeding point;

a radiation element, comprising:

a first radiator, having a first end at which a feeding signal source is coupled to the positive feeding point, and having a plurality of first side edges; and a second radiator, having a first end at which the feeding signal source is coupled to the negative feeding point, and having a plurality of second side edges, wherein the second radiator at least partially surrounds the first radiator, and there are a plurality of predetermined gaps existed in between the plurality of first side edges of the first radiator and the plurality of second side edges of the second radiator to form coupling effects;

a substrate, having a first and a second plane opposite to the first plane, wherein the first radiator is located on the first plane, and the second radiator is located on the second plane; and a grounding element, coupled to the second radiator, comprising:

a first grounding sub-element and a second grounding sub-element, wherein the first grounding sub-element at least overlaps the second grounding sub-element; the first grounding sub-element as well as the first radiator are located on the first plane; and the second grounding sub-element as well as the second radiator are located on the second plane.

2. Then antenna structure of claim 1, wherein a first current flows through the first radiator along the plurality of first side edges; and a second current flows through the second radiator along the plurality of second side edges.

3. The antenna structure of claim 2, wherein the first radiator comprises a plurality of segments, and a current path of the first current flowing through the plurality of segments constitutes a loop.

4. The antenna structure of claim 1, wherein the first radiator comprises a plurality of segments, each of the plurality of segments has an inside edge and an outside edge, and the plurality of first side edges are a plurality of outside edges of the plurality of segments.

5. The antenna structure of claim 1, wherein the second radiator comprises a plurality of segments, each of the plurality of segments has an inside edge and an outside edge, and the plurality of second side edges are a plurality of inside edges of the plurality of segments.

6. The antenna structure of claim 1, further comprising:

a via hole, disposed in between the first grounding sub-element and the second grounding sub-element and passing through the first plane and the second plane of the substrate, for electronically connecting the first grounding sub-element with the second grounding sub-element.

7. The antenna structure of claim 1, wherein the first radiator and the second radiator form a spiral.

8. The antenna structure of claim 1, wherein the plurality of predetermined gaps form a spiral space.

9. The antenna structure of claim 1, wherein the second radiator further comprises a second end, and there is a bend located close to the second end of the second radiator.

10. An antenna structure, comprising:

a positive feeding point and a negative feeding point;

a radiation element, comprising:

a first radiator, having a first end at which a feeding signal source is coupled to the positive feeding point; and a second radiator, having a first end at which the feeding signal source is coupled to the negative feeding point, wherein the second radiator at least partially surrounds the first radiator, and there are a plurality of predetermined gaps between the first radiator and the second radiator to form coupling effects, wherein the plurality of predetermined gaps form a spiral space, and the first radiator as well as the second radiator are disposed around along the spiral space;

a substrate, having a first plane and a second plane opposite to the first plane, wherein the first radiator is located on the first plane, and the second radiator is located on the second plane; and a grounding element, coupled to the second radiator, comprising:

a first grounding sub-element and a second grounding sub-element, wherein the first grounding sub-element at least overlaps the second grounding sub-element, the first grounding sub-element as well as the first radiator are located on the first plane, and the second grounding sub-element as well as the second radiator are located on the second plane.

11. The antenna structure of claim 10, wherein the first radiator comprises a plurality of first side edges of the second radiator comprises a plurality of second side edges; and the plurality of predetermined gaps are located between the plurality of first side edges of the first radiator and the plurality of second edges of the second radiator to form coupling effects.

12. Then antenna structure of claim 11, wherein a first current flows through the first radiator along the plurality of first side edges; and a second current flows through the second radiator along the plurality of second side edges.

13. The antenna structure of claim 12, wherein the first radiator comprises a plurality of segments, and a current path of the first current flowing through the plurality of segments constitutes a loop.

14. The antenna structure of claim 11, wherein the first radiator comprises a plurality of segments, each of the plurality of segments has an inside edge and an outside edge, and a plurality of first side edges are the plurality of outside edges of the plurality of segments.

15. The antenna structure of claim 11, wherein the second radiator comprises a plurality of segments, each of the plurality of segments has an inside edge and an outside edge, and a plurality of second side edges are the plurality of inside edges of the plurality of segments.

16. The antenna structure of claim 10, further comprising:

a via hole, disposed in between the first grounding sub-element and the second grounding sub-element and passing through the first plane and the second plane of the substrate, for electronically connecting the first grounding sub-element with the second grounding sub-element.

17. The antenna structure of claim 10, wherein the second radiator further comprises a second end, and there is a bend located close to the second end of the second radiator.

* * * * *